US009639014B2

(12) United States Patent
Tsurumi et al.

(10) Patent No.: US 9,639,014 B2
(45) Date of Patent: May 2, 2017

(54) ELECTROSTATIC CHARGE IMAGE DEVELOPER, DEVELOPER CARTRIDGE, AND PROCESS CARTRIDGE

(71) Applicant: FUJI XEROX CO., LTD., Tokyo (JP)

(72) Inventors: Yosuke Tsurumi, Kanagawa (JP); Motoko Sakai, Kanagawa (JP); Takuro Watanabe, Kanagawa (JP); Masaaki Usami, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/819,939

(22) Filed: Aug. 6, 2015

(65) Prior Publication Data

US 2016/0246194 A1 Aug. 25, 2016

(30) Foreign Application Priority Data

Feb. 25, 2015 (JP) ..... 2015-034748

(51) Int. Cl.

| | |
|---|---|
| ***G03G 9/10*** | (2006.01) |
| ***G03G 9/00*** | (2006.01) |
| ***G03G 9/08*** | (2006.01) |
| ***G03G 9/107*** | (2006.01) |

(52) U.S. Cl.
CPC ..... *G03G 9/0823* (2013.01); *G03G 9/107* (2013.01); *G03G 9/1075* (2013.01)

(58) Field of Classification Search
CPC .... G03G 9/0823; G03G 9/107; G03G 9/1075; G03G 9/09342; G03G 9/0902
See application file for complete search history.

(56) References Cited

U.S. PATENT DOCUMENTS

| | | | | |
|---|---|---|---|---|
| 2005/0214666 | A1 | 9/2005 | Schulze-Hagenest et al. | |
| 2009/0111042 | A1* | 4/2009 | Kiyono ..... | G03G 9/0819 430/108.6 |
| 2014/0045113 | A1* | 2/2014 | Takahashi ..... | G03G 9/08755 430/105 |

FOREIGN PATENT DOCUMENTS

| | | |
|---|---|---|
| JP | 2007-519982 A | 7/2007 |
| JP | 2013-057906 A | 3/2013 |

* cited by examiner

*Primary Examiner* — Thorl Chea
(74) *Attorney, Agent, or Firm* — Oliff PLC

(57) ABSTRACT

An electrostatic charge image developer includes an electrostatic charge image developing carrier containing a ferrite particle and an electrostatic charge image developing toner containing metallic particles whose resistance is from $10^{10}$ Ωcm to $10^{13}$ Ωcm in an electric field of 10,000 V/cm, wherein the electrostatic charge image developing carrier satisfies the following formula (1): $0.9 \leq R_B/R_A \leq 1.0$ (1), wherein $R_A$ represents the resistance of the electrostatic charge image developing carrier in an electric field of 2,400 V/cm, and $R_B$ represents the resistance of the electrostatic charge image developing carrier in an electric field of 19,200 V/cm.

11 Claims, 2 Drawing Sheets

ELECTROSTATIC CHARGE IMAGE DEVELOPER, DEVELOPER CARTRIDGE, AND PROCESS CARTRIDGE

CROSS-REFERENCE TO RELATED APPLICATIONS

This application is based on and claims priority under 35 USC 119 from Japanese Patent Application No. 2015-034748 filed Feb. 25, 2015.

BACKGROUND

1. Technical Field

The present invention relates to an electrostatic charge image developer, a developer cartridge, and a process cartridge.

2. Related Art

Methods for visualizing image information through an electrostatic charge image, such as electrophotography, are currently used in various fields. In the electrophotography, an electrostatic charge image (electrostatic latent image) is formed on a photoreceptor (image holding member) through charging and exposure processes, the electrostatic latent image is developed with a developer containing a toner, and the developed electrostatic latent image is visualized through transferring and fixing processes.

Recently, it is required to form an image having a metallic color by using a toner containing a metallic pigment.

SUMMARY

According to an aspect of the invention, there is provided an electrostatic charge image developer including:

an electrostatic charge image developing carrier containing a ferrite particle; and an electrostatic charge image developing toner containing metallic particles whose resistance is from $10^{10}$ Ωcm to $10^{13}$ Ωcm in an electric field of 10,000 V/cm, wherein the electrostatic charge image developing carrier satisfies the following formula (1):

$$0.9 \leq R_B/R_A \leq 1.0 \quad (1)$$

wherein $R_A$ represents the resistance of the electrostatic charge image developing carrier in an electric field of 2,400 V/cm, and $R_B$ represents the resistance of the electrostatic charge image developing carrier in an electric field of 19,200 V/cm.

BRIEF DESCRIPTION OF THE DRAWINGS

Exemplary embodiments of the present invention will be described in detail based on the following figures, wherein.

DETAILED DESCRIPTION

Figure 1:
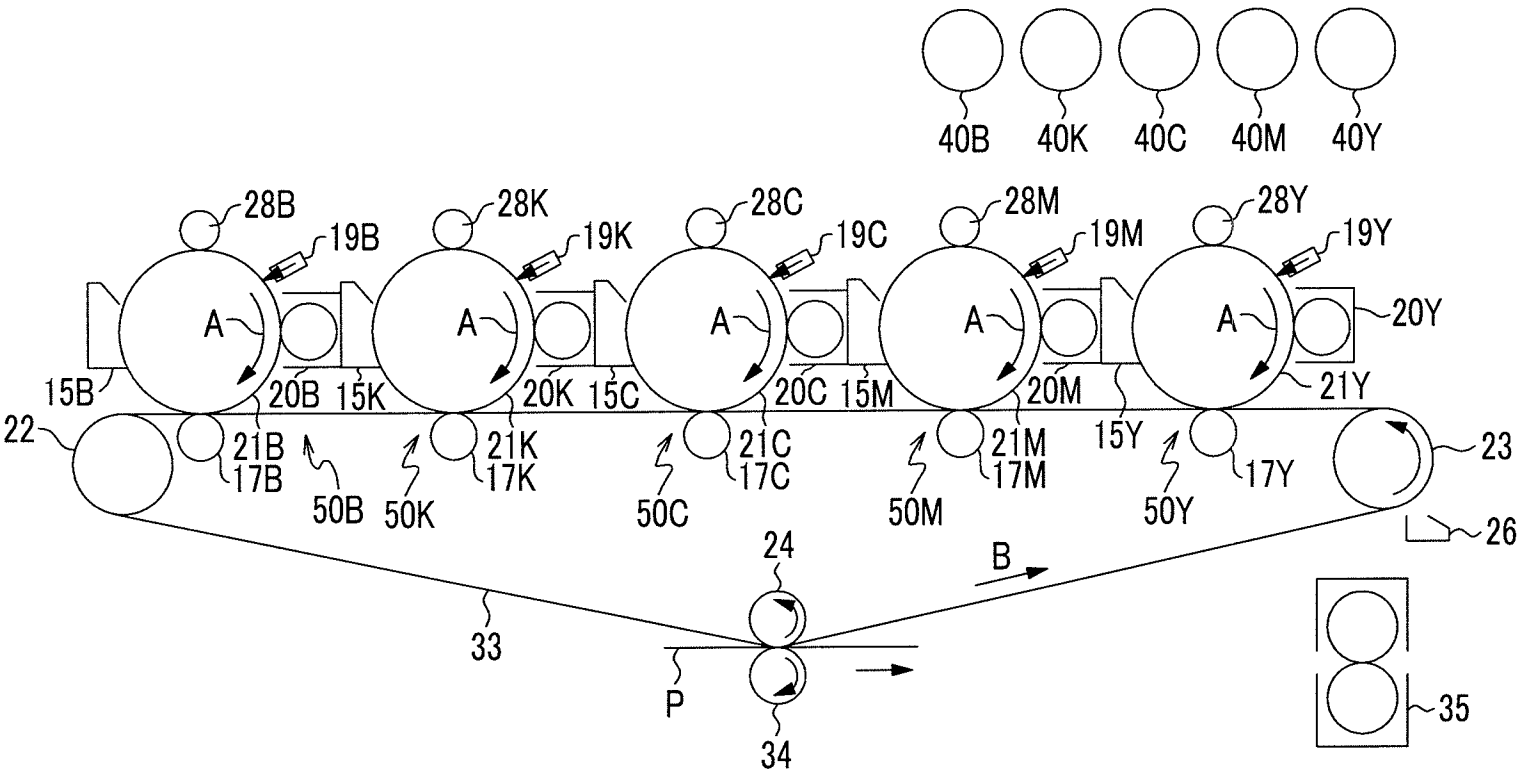
FIG. 1 is a schematic configuration view showing an example of an image forming apparatus according to the exemplary embodiment.

Hereinafter, the exemplary embodiment of the invention will be described.

In the exemplary embodiment, the description "A to B" represents not only the range between A and B but also the range including A and B as both ends thereof. For example, if the "A to B" is a numerical range, it represents "A or more and B or less".

In addition, in the exemplary embodiment, the term "(meth)acryl" is a representation including both "acryl" and "methacryl".

In the exemplary embodiment, a combination of two or more of preferable exemplary embodiments is a more preferable exemplary embodiment.

1. Electrostatic Charge Image Developer

The electrostatic charge image developer of the present invention includes: an electrostatic charge image developing carrier (hereinafter, also simply referred to as a "carrier") containing a ferrite particle; and an electrostatic charge image developing toner (hereinafter, also simply referred to as a "toner") containing metallic particles. Here, if the resistance of the electrostatic charge image developing carrier in an electric field of 2,400 V/cm is expressed by $R_A$ and the resistance thereof in an electric field of 19,200 V/cm is expressed by $R_B$, the relationship between $R_A$ and $R_B$ satisfies the following formula (1), and the resistance of the metallic particles in an electric field of 10,000 V/cm is from $10^{10}$ Ωcm to $10^{13}$ Ωcm.

$$0.9 \leq R_B/R_A \leq 1.0 \quad (1)$$

The present inventors have found that, according to the electrostatic charge image developer in the exemplary embodiment, it is possible to provide an image in which the occurrence of starvation and image unevenness is prevented, even when high-speed printing is performed at low temperature and low humidity.

Although detailed mechanism is unclear, inventors have presumed this mechanism as follows. Generally, image formation by an electrophotographic method is performed by the following steps. That is, the developer in a developing device is stirred and charged, the charged developer is supplied to a magnet roll of the developing device, and development by a toner is performed on a photoreceptor which has an arbitrary charge and faces the magnet roll, to thereby form an image. In this case, if the resistance of a carrier in the developer is large, when the toner is separated from the carrier, a charge opposite to that of the toner tends to remain on the carrier. When this charge is increased, there is a case where the toner developed on the photoreceptor is transferred to the carrier, and deletion where the toner does not remain in the image occurs. Such a phenomenon is referred to as starvation (deletion of an image). Such a phenomenon is remarkable under an environment of low temperature and low humidity in which the resistance of the carrier easily becomes high. Although the occurrence of starvation is prevented by making the resistance low, when the resistance of the carrier is lowered, in the stirring and charging of the developer, the charge of the toner easily goes out of the carrier, thus making charge stability poor. Therefore, image unevenness easily occurs. Particularly, the occurrence of image unevenness is remarkable in high-speed printing in which the toner is fast replaced.

In addition, under an environment of low temperature and low humidity, the charge of the developer easily accumulates, and a charge-up phenomenon, in which the charge amount of the developer increases in proportion to the increase in the number of printed sheets, easily occurs. For this reason, the developing properties of the toner to the photoreceptor easily deteriorate, and, as a result, there is a problem of causing image unevenness. In the electrostatic charge image developer of the related art, when high-speed printing is performed under an environment of low temperature and low humidity, it is difficult to prevent the occurrence of both starvation and image unevenness.

Since the change in the resistance of the carrier is small with respect to the change in electric field around the developing device in the case where the developer of the exemplary embodiment is used, it is presumed that the change in the charge amount of the developer is prevented with respect to printing speed. In addition, when metallic particles having a predetermined resistance value are present, since the metallic particles have a low dielectric constant compared to that of resin particles, it is presumed that a charge is less likely to accumulate, suitable charge leakage due to suitable resistance occurs, charging rise is prevented even under an environment of low humidity, and the occurrence of image unevenness is prevented.

Hereinafter, an electrostatic charge image developing carrier and a toner will be described in detail in this order.

Electrostatic Charge Image Developing Carrier

The electrostatic charge image developer according to the exemplary embodiment includes an electrostatic charge image developing carrier and an electrostatic charge image developing toner. Here, the electrostatic charge image developing carrier contains ferrite particle, and satisfies the following formula (1) when the resistance thereof in an electric field of 2,400 V/cm is expressed by $R_A$ and the resistance thereof in an electric field of 19,200 V/cm is expressed by $R_B$.

$$0.9 \leq R_B/R_A \leq 1.0 \quad (1)$$

Since resistance is large when $R_B/R_A$ is less than 0.9, it cannot respond to the change in the electric field around a developing device and the change in printing speed, and thus image unevenness tends to occur. Further, when $R_B/R_A$ is more than 1.0, abnormal contact electric field of the carrier particle, particularly, the uneven distribution of the coated layer of the coated carrier or the abnormal conductive portion of the coated layer of the coated carrier is supposed, and thus toner charging imparting ability easily becomes unstable.

It is preferable that $R_B/R_A$ is from 0.95 to 1.0.

The resistance of the electrostatic charge image developing carrier in an electric field of 19,200 V/cm is preferably from $10^{10}$ Ωcm to $10^{13}$ Ωcm, and more preferably from $10^{11}$ Ωcm to $10^{12}$ Ωcm. When the resistance of the carrier in an electric field of 19,200 V/cm is $10^{10}$ Ωcm or more, the surface charge of the carrier becomes stable, and thus the occurrence of image unevenness is more prevented. Further, when the resistance thereof is $10^{13}$ Ωcm or less, the surface charge of the carrier is present in an appropriate range, the surface charge thereof become uniform, and thus the occurrence of image unevenness is more prevented.

Here, the resistance of the carrier in an electric field of 2,400 V/cm and the resistance of the carrier in an electric field of 19,200 V/cm are measured as follows.

Two polar plates face each other in parallel with a width of 1 mm, 0.25 g of the carrier is put therebetween, the two polar plates are held by a magnet having a cross-sectional area of 2.4 $cm^2$, a voltage of 100 V is applied, and a current value is measured. At this time, the electric field is 2,400 V/cm. The resistance value is calculated from the obtained current value.

Further, similarly, a current value is measured at an applied voltage of 800 V. At this time, the electric field is 19,200 V/cm.

Here, the temperature and relative humidity (RH) at the time of measurement are set to 10° C. and 15%, respectively.

Ferrite Particles

In the exemplary embodiment, the electrostatic charge image developing carrier contains ferrite particle. In the exemplary embodiment, the electrostatic charge image developing carrier contains ferrite particle as magnetic particle, and, preferably, at least a part of the surface of the ferrite particle is coated with a resin.

As the ferrite, ferrite having a structure represented by the following formula is exemplified.

$$(MO)_X(Fe_2O_3)_Y \quad \text{Formula:}$$

In the formula, M represents at least one selected from the group consisting of Cu, Zn, Fe, Mg, Mn, Ca, Li, Ti, Ni, Sn, Sr, Al, Ba, Co, and Mo. Further, each of X and Y represents a molar ratio, and X+Y=100.

Among the ferrites having a structure represented by the above formula, examples of the ferrites having a structure in which M represents a plurality of metals include known ferrites, such as manganese-zinc ferrite, nickel-zinc ferrite, manganese-magnesium ferrite, and copper-zinc ferrite.

As the ferrite grains in the exemplary embodiment, manganese ferrite is preferable. Manganese ferrite contains at least Fe and Mn as metal, and is good in the balance of magnetization and resistance. Manganese ferrite may contain metals other then Fe and Mn, and examples thereof include Mn—Mg ferrite and Mn—Zn ferrite.

The volume average particle diameter (D50v) of the ferrite particles used in the exemplary embodiment is preferably from 30 μm to 50 μm.

The volume average particle diameter of magnetic particles or pulverized particles in the exemplary embodiment is a value measured by a laser diffraction particle size distribution measuring device LA-700 (manufactured by HORIBA Ltd.). The volume cumulative distribution is drawn from small particle size side with respect to the particle size range (channel) formed by dividing the obtained particle size distribution, and the particle diameter corresponding to a cumulative value of 50% refers to the volume average particle diameter (D50v).

The ferrite particles used in the carrier, like soft ferrite, are required to be magnetized in a magnetic field and, reduce the magnetization thereof when separated from the magnetic field. When a magnetic member in which magnetization is maintained each other once it is magnetized, like hard ferrite, is used in the carrier, a phenomenon in which carrier particles attract or repel is caused in a developing device, and thus it is difficult to stir the developer. Therefore, the charging of the developer becomes insufficient, and an image easily becomes problematic.

In the related art, it is difficult for soft ferrite to satisfy the desired resistance ratio of the exemplary embodiment. Since soft ferrite has different metal ions in addition to iron and oxygen, the migration of electrons in the system is prevented, and thus it is easy to keep the resistance even in a high electric field. Examples of the metals used in soft ferrite include Li, Mg, Ti, Cr, Mn, Co, Ni, Cu, and Zn.

The method of preparing ferrite particles is not particularly limited, but, for example, may be performed by the following processes.

The materials for constituting ferrite are blended in an appropriate amount, pulverized by a bead mill or the like, and then heated to obtain oxide (calcinations). Next, this oxide is blended with a dispersant and a binder resin such as polyvinyl alcohol in an appropriate amount, and pulverized/mixed by a wet ball mill or the like. At the time of pulverization/mixing, if necessary, an Si compound (such as $SiO_2$ having a volume average particle diameter of from 15 nm to 150 nm) is added. Next, the resultant is granulated and dried by a spray dryer or the like to prepare particles before baking. The final particle diameter is determined by the particle diameter at this time. Thereafter, these particles are baked, and then may be pulverized and classified in a desired particle diameter distribution to obtain ferrite particles. Here, in the baking, it is preferable to lower oxygen partial pressure. Further, after the baking, in order to adjust the surface of the ferrite particles, it is also preferable to perform heating in the air (post adjustment).

These preparation conditions are different depending on the kind of added materials. Therefore, targeted ferrite particles are prepared by the combination of the composition of added materials with the preparation conditions.

This time, it is possible to obtain targeted ferrite particles by the following method.

It is preferable that ferrite particles are prepared by forming suitable unevenness on the surface of ferrite particles with small grain aggregates. Specifically, calcination is performed at a temperature of from 800° C. to 1,000° C. Next, polycarboxylic acid, water, polyvinyl alcohol or the like is added as a dispersant, $SiO_2$ is further added, and mixing and pulverization are performed. Then, granulation and drying are performed by a spray dryer or the like. Thereafter, dried particles are baked at a temperature of from 1,300° C. to 1,500° C. At this time, the oxygen ratio around the particles is lowered. Further, baking is performed at a temperature of from 800° C. to 1,000° C. in the air, and crushing and classifying are performed, to thereby obtain desired ferrite particles.

Next, it is preferable that resin coating is performed such that coverage is approximately from 85% to 99%, and thus the resistance in a low electric field is controlled by suitable resin coating and the resistance in a high electric field is controlled by suitable surface control, to thereby obtain ferrite particles having targeted resistance. More preferably, the resin coverage is from 90% to 98%.

Calcination temperature is more preferably from 850° C. to 900° C., and baking temperature is more preferably from 1,350° C. to 1,450° C.

Generally, ferrite particle has a structure having an oxide of a transition metal such as iron or manganese as a core in order to obtain magnetic properties. The transition metal has lone electrons in the inner core orbital thereof, and its magnetic properties are likely to be higher as the number of lone electrons increases. However, when the number of lone electrons is large, the movement of the electrons becomes easy, and thus the resistance of the transition metal is easily lowered. Therefore, it is difficult to increase the resistance of ferrite particles while maintaining the magnetization of ferrite particles. Particularly, the resistance of ferrite particles is easily lowered in a high electric field, and thus the resistance ratio of ferrite particles in a low electric field and a high electric field easily becomes high.

At this time, in the ferrite particles, although the degree of oxidation of the ferrite particles in the vicinity of the surface thereof is increased and the resistance of the ferrite particles is increased in the post-adjustment by heating, the oxidation of the ferrite particles does not proceed to the inside thereof, and thus the magnetization of the inside thereof is not lowered, and it is possible to achieve both of magnetization and resistance. Moreover, the unevenness of the surface of the ferrite particles is adjusted in a suitable range to perform resin coating at a suitable coverage, and thus the ratio of a resin portion having high resistance and a ferrite particle portion having low resistance is appropriate. Therefore, the resistance of the ferrite particles is not too high, which is suitable. Particularly, when the Sm and Ry of the surface are set in the above range, the ferrite particles of the exposed portion appear from a resin coated film at a suitable height, thereby suitably adjusting the resistance of the ferrite particles.

In addition, resin is strongly correlated to low electric field resistance, and ferrite particles are strongly correlated to high electric field resistance, and thus it is possible to make the ratio of low electric field resistance and high electric field resistance small.

In the control of surface unevenness of ferrite particles, it is possible to control Sm by the amount of $SiO_2$. When the amount of $SiO_2$ increases, the growth of grain boundaries easily proceeds by baking. It is possible to control Ry by oxygen concentration at the time of baking. When oxygen concentration is low, grain boundary easily becomes uniform, and Ry easily becomes small.

Further, the particle diameter of pulverized ferrite particles after calcination may be used in the control of both Sm and Ry. When D50 is small, Sm becomes small, and Ry becomes small. The reason for this is that the amount of heat necessary for the growth of grain boundaries increases due to the increase in specific surface area. This particle diameter of pulverized ferrite particles is strongly effective in Sm, and is weakly effective in Ry. The targeted surface unevenness may be obtained by the combination of these procedures.

In order to uniform the unevenness of the surface, as baking conditions, it is preferable that ferritization is performed while forming a surface shape by calcinations at low temperature, baking is performed for a short time under low oxygen partial pressure at high temperature, ferritization for obtaining magnetization is performed, and then heating is performed as post-adjustment for smoothing the surface at low temperature.

In the exemplary embodiment, the surface roughness Sm (average interval between unevenness) of ferrite particles is preferably from 1.0 μm to 5.0 μm, more preferably from 3.0 μm to 4.0 μm, and further preferably from 3.0 μm to 3.5 μm. When the surface roughness Sm of ferrite particles is within the above range, the contact area with a toner is within the suitable range, frictional charging easily occurs, and the leakage of a charge is reduced.

Further, the maxim height Ry of ferrite particles is preferably from 0.2 μm to 0.7 μm, more preferably from 0.3 μm to 0.5 μm, and further preferably from 0.4 μm to 0.5 μm. When the maxim height Ry of ferrite particles is within the above range, the portion protruding from the resin-coated surface becomes small, and the leakage of a charge is prevented. Further, when Ry is smaller than 0.2 μm, the contact point with a toner is reduced, and resistance control becomes difficult (charge leakage may not be suitably performed to allow resistance not to be too high).

When resin coating, which will be described later, is performed on the ferrite particles having the above surface unevenness such that coverage is preferably from 80% to 99%, the resin-coated surface and the exposed surface of the ferrite particles exist appropriately, and, particularly, the exposed surface has a sea-island structure to the resin, and thus the resistance of the ferrite particles in a low electric field is controlled in an appropriate range.

The above surface roughness Sm and maximum height Ry are values measured according to JIS B 0601-1994.

Specifically, the above surface roughness Sm and maximum height Ry are obtained by observing surfaces of 50 carriers at a magnification of 3,000 times using an ultra-deep color 3D profile measuring microscope (VK-9500, manufactured by Keyence Ltd.). The maximum height Ry is obtained by obtaining a roughness curve, extracting only a reference length in the direction of the average line of the roughness curve and then obtaining the sum (Yp+Yv) of the height Yp from the average line of this extracted portion to the highest mountain top and the depth Yv from the average line of this extracted portion to the lowest valley bottom. Here, at the time of obtaining the maximum height Ry, the reference length is 10 μm, and the cut-off value is 0.08 mm.

The surface roughness Sm (average interval between irregularities) is an average value of intervals in one period of mountain and valley, which is obtained by obtaining a roughness curve, and the intersection of the average line with the roughness curve. Here, at the time of obtaining the surface roughness Sm, the reference length is 10 μm, and the cut-off value is 0.08 mm.

Meanwhile, in the preparation of ferrite particles, when the amount of $SiO_2$ added increases, the surface roughness Sm tends to increase. Further, when the particle size (D50) of pulverized particles after the calcination increases, Sm tends to increase, and Ry tends to increase slightly. When baking temperature is high, Sm tends to increase slightly, and Ry tends to decrease. When oxygen partial pressure is high during baking, Ry tends to increase. When heating temperature is high in post adjustment, resistance tends to increase.

Coating Layer

Examples of the resin contained in the coating layer which covers ferrite particles (coating resin) include polyethylene, polypropylene, polystyrene, polyvinyl acetate, polyvinyl alcohol, polyvinyl butyral, polyvinyl chloride, polyvinyl ether, polyvinylketone, vinyl chloride-vinyl acetate copolymer, styrene-acrylic acid copolymer, alkyl (meth)acrylate resin, straight silicone resin having organosiloxane bonds or a modified product thereof, fluororesin, polyester, polycarbonate, phenol resin, and epoxy resin. The term "(meth)acrylate" as used herein means acrylate or methacrylate.

It is preferable that the coating layer contains a resin having a cycloalkyl group. Examples of the resin having a cycloalkyl group include: (1) a homopolymer of a monomer containing a cycloalkyl group; (2) a copolymer of two or more kinds of monomers having a cycloalkyl group; and (3) a copolymer of a monomer containing a cycloalkyl group and a monomer not containing a cycloalkyl group.

When the resin containing a cycloalkyl group is used in the coating layer, the excess charging of a toner at low temperature and low humidity may be prevented, and the density unevenness of an image may be prevented.

In the above (1) to (3), examples of the cycloalkyl group include 3-membered to 10-membered cycloakyl groups, preferably include 3-membered to 8-membered (carbon number of from 3 to 8) cycloakyl groups, and more preferably 5-membered to 6-membered (carbon number of from 5 to 6) cycloakyl groups (cyclopentyl and cyclohexyl) from the viewpoint of stability of a charge on the surface of the carrier. When a cycloalkyl group having a carbon number of 8 or less is used, steric hindrance is small, and a resin having good durability is obtained. When a cycloalkyl group having a carbon number of 5 or 6 is used, it is stable as a cyclic structure.

The structure of the cycloalkyl group is determined by the NMR of the resin.

The resin having a cycloalkyl group is preferably a resin containing a polymerization unit derived from at least one selected from the group consisting of cycloalkyl acrylate and cycloalkyl methacrylate. Specific examples of the resin include cycloalkyl acrylate, cycloalkyl methacrylate, a copolymer of cycloalkyl methacrylate and alkyl methacrylate, a copolymer of cycloalkyl acrylate and alkyl methacrylate, a copolymer of cycloalkyl methacrylate and alkyl acrylate, a copolymer obtained by combination of cycloalkyl acrylate, cycloalkyl methacrylate, alkyl acrylate and alkyl methacrylate, a copolymer of cycloalkyl methacrylate and styrene, a copolymer of cycloalkyl acrylate and styrene, a polyester resin having a cycloalkyl group in a branch side chain, an urethane resin having a cycloalkyl group in a branch side chain, and an urea resin having a cycloalkyl group in a branch side chain.

Particularly, the resin having a cycloalkyl group is preferably (3) a copolymer of a monomer containing a cycloalkyl group and a monomer not containing a cycloalkyl group, more preferably a copolymer of at least one selected from cycloalkyl acrylate and cycloalkyl methacrylate and methyl methacrylate, and further preferably a copolymer of cycloalkyl acrylate and methyl methacrylate. When the resin having a cycloalkyl group is a copolymer of cycloalkyl acrylate and methyl methacrylate, the prevention of change in the charge amount is maintained. This effect is considered to be due to improvement of the adhesiveness between the coating layer and the magnetic particles.

The copolymerization ratio (molar ratio of at least one of cycloalkyl acrylate and cycloalkyl methacrylate:methyl methacrylate) of a copolymer of methyl methacrylate and at least one of cycloalkyl acrylate and cycloalkyl methacrylate is from 85:15 to 99:1.

Further, the weight average molecular weight (Mw) of the resin having a cycloalkyl group is preferably 3,000 to 200,000.

Here, the weight average molecular weight thereof is measured by gel permeation chromatography (GPC). As the GPC, HLC-8120 GPC or SC-8020 (manufactured by Tosoh Corporation) is used. Two columns, TSK gel, Super HM-H (6.0 mmID×15 cm, manufactured by Tosoh Corporation) are used. As an eluent, tetrahydrofuran (THF) is used. Experiment is carried out using a refractive index (RI) detector (differential refractive index detector) under experimental conditions of a sample concentration of 0.5% by weight, a flow rate of 0.6 mL/min, a sample injection amount of 10 μL and a measuring temperature of 40° C. The calibration curve is prepared from ten samples of polystyrene standard samples "TSK standards", manufactured by Tosoh Corporation, such as "A-500", "F-1", "F-10", "F-80", "F-380", "A-2500", "F-4", "F-40", "F-128", and "F-700".

Further, in the carrier according the exemplary embodiment, conductive particles (particles having volume resistivity at 20° C.: $1\times10^{-6}$ Ωcm or less) may be dispersed in the coating layer. Examples of the conductive particles include, but are not limited to, metals, such as gold, silver, and copper, carbon black, titanium oxide, zinc oxide, barium sulfate, aluminum borate, potassium titanate, and tin oxide.

Among these, preferably, the carrier contains carbon black in the coating resin. The content of carbon black is preferably from 1.0% by weight to 3.0% by weight, more preferably from 1.0% by weight to 2.0% by weight, and further preferably from 1.0% by weight to 1.5% by weight, with respect to the coating resin. When the content of carbon black in the carrier is within the above range, the distribution of triboelectric charging becomes narrow, which is preferable.

In addition, the electrostatic charge image developing carrier according to the exemplary embodiment is preferably a resin-coated carrier in which a part of the surface of ferrite particles is coated with a resin. In this case, the coverage of ferrite particles is preferably from 70% to 98%, and more preferably from 90% to 98%, such that carrier resistance depends on the ferrite particles.

Here, the coverage thereof, for example, is obtained by measuring the coverage through the following method.

The carrier is fixed to a sample holder using ESCA-9000MX (manufactured by NJEOL, Ltd.) as an X-ray photoelectron spectrometer, and is inserted into the chamber of the ESCA. The vacuum degree of the chamber is set to $1\times10^{-6}$ Pa or less, Mg-Kα is used as an excitation source, and the output is set to 200 W. The XPS spectra of the magnetic particles and the carrier are measured under the above conditions, and the coverage is calculated from the ratio of area intensity of Fe peak (2p3/2) of the detected element.

$$\text{Coverage}=F2/F1\times100$$

(F1: Fe area intensity of magnetic particles, F2: Fe area intensity of carrier)

As the method of coating a part of the surface of magnetic particles with a resin, there is exemplified a method of coating a part of the surface of magnetic particles using a coating layer forming solution which is obtained by dissolving or dispersing a resin having a cycloalkyl group and, if necessary, various additives in an appropriate solvent. The solvent is not particularly limited, and may be selected in consideration of a coating resin used, application adaptability, and the like.

More specifically, examples of the method include a dipping method of dipping magnetic particles into the coating layer forming solution, a spray method of spraying the coating layer forming solution onto the surface of magnetic particles, a fluid bed method of spraying the coating layer forming solution while suspending magnetic particles using flowing air, and a kneader coater method of mixing magnetic particles and the coating layer forming solution in a kneader coater and removing a solvent.

The volume average particle diameter of the carrier of the exemplary embodiment is preferably from 30 μm to 90 μm, and more preferably from 35 μm to 80 μm. When the volume average particle diameter thereof is 30 μm or more, the adherence of the carrier to a photoreceptor is difficult to occur. When the volume average particle diameter thereof is 90 μm or less, the deterioration of image quality is prevented.

When the carrier of the exemplary embodiment has a coating layer, the average thickness of the coating layer is preferably from 0.5 μm to 2.5 μm, and more preferably from 1.0 μm to 2 μm.

Electrostatic Charge Image Developing Toner

The electrostatic charge image developer according to the exemplary embodiment includes an electrostatic charge image developing toner.

The electrostatic charge image developing toner contains metallic particles, and the resistance of the metallic particles in an electric field of 10,000 V/cm is from $10^{10}$ Ωcm to $10^{13}$ Ωcm.

Metallic Particles

The resistance of the metallic particles contained in the electrostatic charge image developing toner in an electric field of 10,000 V/cm is from $10^{10}$ Ωcm to $10^{13}$ Ωcm. When the resistance of the metallic particles in an electric field of 10,000 V/cm is less than $10^{10}$ Ωcm, the leakage of a charge is strong and charging is not stable, and thus image unevenness is easy to occur. Further, when the resistance of the metallic particles in an electric field of 10,000 V/cm is more than $10^{13}$ Ωcm, charges easily accumulate, charging is not stable, and thus image unevenness is easy to occur.

It is preferable that the resistance of the metallic particles in an electric field of 10,000 V/cm is from $10^{11}$ Ωcm to $10^{12}$ Ωcm.

The metallic particle used in the exemplary embodiment is not particularly limited as long as it has the above desired resistance, but, the metallic particle preferably has a first coating layer and a second coating layer, the first coating layer covering the surface of the metallic pigment and containing at least one metal oxide selected from the group consisting of silica, alumina and titania and the second coating layer covering the surface of the first coating layer and containing a resin.

The metallic particle includes the first coating layer containing the specific metal oxide, thus preventing the exposure of the metallic pigment exhibiting conductivity to the surface of toner particles. In addition, it is considered that the injection of charges becomes difficult, and charging properties become good.

In addition, since the metallic particle includes the second coating layer containing a resin and this layer exhibits good adhesiveness to a binder resin for constituting the toner particle, it is presumed that the binder resin nearly uniformly adheres to the surface of the metallic particle, and the exposure of the metallic pigment from the surface of the toner particle is prevented, and thus the occurrence of starvation is prevented. Further, since the binder resin nearly uniformly adheres to the surface of the metallic particle, it is easy to arrange the longitudinal direction of the metallic pigment in the toner so as to face the surface of a recording medium, and thus an image having excellent brilliance is obtained.

It is preferable that the metallic particle is composed of a metallic pigment, a first coating layer containing at least one metal oxide selected from the group consisting of silica, alumina, and titania covering the surface of the metallic pigment, and the second coating layer containing a resin and covering the surface of the first coating layer.

Examples of the metallic pigment for constituting the metallic particle include metal powder of, for example, aluminum, brass, bronze, nickel, stainless steel, zinc, copper, silver, gold, and platinum.

Among these, aluminum is preferably used from the viewpoint of excellent metallic luster or easiness handling due to small specific gravity.

It is preferable that the first coating layer for constituting the metallic particle contains at least one metal oxide selected from the group consisting of silica, alumina, and titania. These metal oxides may be used singly or in combination of two or more kinds thereof.

Among the above metal oxides, silica is more preferable from the viewpoints that it is excellent in chemical resistance at the time of preparing toner particles and it may cover the surface of the pigment in a more nearly uniform state.

Here, the first coating layer may contain only the above metal oxide, but may contain impurities contained in the preparation.

Examples of the method of coating the surface with metal oxide include a method of forming a coating layer of metal oxide on the surface of the metallic pigment by a sol-gel process and a method of forming a coating layer of metal oxide by depositing metal hydroxide on the surface of the metallic pigment and crystallizing the deposited metal oxide at low temperature.

Among these, it is preferable that an organic metal compound is added, and a hydrolysis catalyst is added into a metallic pigment-containing dispersion to adjust the pH of the dispersion, thereby depositing metal hydroxide on the surface of the metallic pigment.

The coverage of the first coating layer is preferably from 10% by weight to 40% by weight, and more preferably from 20% by weight to 30% by weight, with respect to the weight of the metallic pigment.

In addition, the coverage of the first coating layer is measured by a calibration curve which is obtained by previously measuring a mixture of aluminum pigment and silica particles using an X-ray fluorescence analyzer (XRF).

The second coating layer for constituting the metallic particle is a coating layer containing a resin.

As the resin used herein, resins known as the binder resin of the toner particles as described later, such as acrylic resin, polyester resin, are used.

Among these, acrylic resin is preferable from the viewpoint that it is capable of uniformly coating the surface of pigment.

In addition, the second coating layer is preferably a layer made of a cross-linked resin from the viewpoint of excellent chemical resistance in the preparation of the toner particles or impact resistance.

Here, the second coating layer may contain only the above resin, but may contain impurities contained in the preparation.

The coverage of the second coating layer is preferably from 5% by weight to 30% by weight, more preferably from 10% by weight to 25% by weight, and further preferably from 15% by weight to 20% by weight, with respect to the weight of the metallic pigment.

When the coverage of the second coating layer is 5% by weight or more, the coatability of the metallic particles by the binder resin is maintained, and thus the deterioration of transfer properties at high temperature and high humidity is prevented. Further, when the coverage of the second coating layer is 20% by weight or less, the deterioration of specular reflectance by the resin constituting the second coating layer is prevented, and thus an image having excellent brilliance is formed.

In addition, the coverage of the second coating layer is measured by the weight reduction rate obtained when temperature is increased from 30° C. to 600° C. at a heating rate of 30° C./min under a nitrogen stream, using a thermogravimetric analyzer (TGA).

When the coverage of the second coating layer in the metallic particle in the toner particle is measured, components such as the binder resin (and a release agent and other components) are removed from the toner particles by dissolving, firing or the like, and then the above-mentioned method may be applied.

Further, since a release agent and other components are mixed in the binder resin in the toner particles, the coverage of the second coating layer may be measured by distinguishing the second coating layer in the metallic particle from the mixed area of these components.

The second coating layer is formed as follows.

That is, the solid-liquid separation of the metallic particles provided with the first coating layer is performed, and, if necessary, cleaning is performed, and then the cleaned metallic particles are dispersed in a solvent, and a polymerizable monomer and a polymerization initiator are added with stirring, and then heating treatment is performed, to thereby deposit a resin on the surface of metallic pigment.

In this way, the second coating layer is formed.

In the toner of the exemplary embodiment, the content of metallic particles is preferably from 1 part by weight to 70 parts by weight, and more preferably from 5 parts by weight to 50 parts by weight, with respect to 100 parts by weight of the binder resin which will be described later.

Binder Resin

In the exemplary embodiment, it is preferable that the electrostatic charge image developing toner contains a binder resin.

Examples of the binder resin include vinyl resins which are homopolymers of momomers or copolymers of two or more kinds of momoners, examples of the monomers including styrenes (such as styrene, para-chloro styrene, and α-methyl styrene), (meth)acrylic esters (such as methyl acrylate, ethyl acrylate, n-propyl acrylate, n-butyl acrylate, lauryl acrylate, 2-ethylhexyl acrylate, methyl methacrylate, ethyl methacrylate, n-propylmethacrylate, laurylmethacrylate, and 2-ethylhexyl methacrylate), ethylenically unsaturated nitriles (such as acrylonitrile and methacrylonitrile), vinyl ethers (such as vinyl methyl ether, and vinyl isobutyl ether), vinyl ketones (such as vinyl methyl ketone, vinyl ethyl ketone, and vinyl isopropenyl ketone), and olefins (such as ethylene, propylene, and butadiene).

Examples of the binder resin also include non-vinyl resins such as epoxy resins, polyester resins, polyurethane resins, polyamide resins, cellulose resins, polyether resins, modified rosin, mixtures of these resins with the above-mentioned vinyl resins, and graft polymers obtained by polymerizing vinyl monomers in the coexistence of these resins.

These binder resins may be used singly or in combination of two or more kinds thereof.

As the binder resin, the polyester resins are preferable.

Examples of the polyester resins include known polyester resins.

An example of the polyester resin includes a condensation polymer of a polyvalent carboxylic acid and a polyol. In addition, as the polyester resin, commercially available products may be used, or synthetic resins may be used.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkyenyl succinic acid, adipic acid and sebacic acid), alicyclic dicarboxylic acids (for example, cyclohexane dicarboxylic acid), aromatic dicarboxylic acids (for example, terephthalic acid, isophthalic acid, phthalic acid, and naphthalene dicarboxylic acid) and anhydrides thereof and lower alkyl esters (for example, those having a carbon number of from 1 to 5) thereof. Among these polyvalent carboxylic acids, for example, aromatic dicarboxylic acids are preferably used.

As the polyvalent carboxylic acids, a trivalent or higher valent carboxylic acid which has a crosslinked structure or a branched structure may be used with dicarboxylic acids. Examples of the trivalent or higher valent carboxylic acid include trimellitic acid, pyromellitic acid, and anhydrides thereof and lower alkyl esters (for example, those having a carbon number of from 1 to 5) thereof.

These polyvalent carboxylic acids may be used singly or in combination of two or more kinds thereof.

Examples of the polyol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol and hydrogenated bisphenol A) and aromatic diols (for example, ethylene oxide adducts of bisphenol A and propylene oxide adducts of bisphenol A). Among these polyols, for example, aromatic diols and alicyclic diols are preferably used, and aromatic diols are more preferably used.

As the polyols, a trivalent or higher valent polyol which has a cross linked structure or a branched structure may be used with diols. Examples of the trivalent or higher valent polyol include glycerin, trimethylolpropane, and pentaerythritol.

These polyols may be used singly or in combination of two or more kinds thereof.

The glass transition temperature (Tg) of the polyester resin is preferably from 50° C. to 80° C. and more preferably from 50° C. to 65° C.

In addition, the glass transition temperature is calculated from a DSC curve obtained from differential scanning calorimetry (DSC) and more specifically, the glass transition temperature is calculated according to "extrapolated glass transition starting temperature" described in a method of calculating glass transition temperature in "Testing methods for transition temperatures of plastics" of JIS K7121-1987.

The weight average molecular weight (Mw) of the polyester resin is preferably from 5,000 to 1,000,000, and more preferably from 7,000 to 500,000.

The number average molecular weight (Mn) of the polyester resin is preferably from 2,000 to 100,000.

The molecular weight distribution Mw/Mn of the polyester resin is preferably from 1.5 to 100, and more preferably from 2 to 60.

The weight average molecular weight and the number average molecular weight are measured by gel permeation chromatography (GPC). The GPC molecular weight measurement is performed using HLC-8120 GPC (manufactured by Tosoh Corporation) as a measurement device and TSK gel Super HM-M (15 cm) (manufactured by Tosoh Corporation) as a column with THF as a solvent. The weight average molecular weight and the number average molecular weight are calculated using a molecular weight calibration curve prepared using a mono-dispersed polystyrene standard sample from the measurement result.

The polyester resin may be prepared using a known preparation method. Specifically, for example, there may be a method of preparing a polyester resin at a polymerization temperature in a range from 180° C. to 230° C. by reducing the pressure in the reaction system, as necessary, and reacting raw materials while removing water and alcohol formed during condensation.

In addition, when raw material monomers are not dissolved or compatible with each other at the reaction temperature, a solvent having a high boiling point may be added thereto as a dissolution aid to dissolve the monomers. In this case, the polycondensation reaction is performed while distilling the dissolution aid. When a monomer having a poor compatibility is present, in the copolymerization reaction, the polycondensation reaction may be performed with the main component after condensing the monomer having a poor compatibility with the acid or alcohol to be polycondensed with the monomer.

Release Agent

It is preferable that the electrostatic charge image developing toner according to the exemplary embodiment contains a release agent.

Examples of the release agent include hydrocarbon wax; natural wax such as carnauba wax, rice wax and candelilla wax; synthetic or mineral and petroleum wax such as montan wax; and ester wax such as fatty acid ester and montanic acid ester. However, there is no limitation thereto.

The melting temperature of the release agent is preferably from 50° C. to 110° C. and more preferably from 60° C. to 100° C.

In addition, the melting temperature is calculated from the DSC curve obtained from differential scanning calorimetry (DSC) according to a "melting peak temperature" described in a method of calculating melting temperature in "Testing methods for transition temperatures of plastics" of JIS K7121-1987.

The content of the release agent is preferably, for example, from 1% by weight to 20% by weight and more preferably from 5% by weight to 15% by weight with respect to the total amount of the toner particles.

Other Additives

Examples of the other additives include known additives such as a magnetic material, a charge-controlling agent, and an inorganic powder. These additives are contained in the toner particles as an internal additive.

Method of Preparing Toner

The toner according to the exemplary embodiment may be prepared by preparing toner particles and if desired, externally adding an external additive to the toner particles.

A method of preparing toner particles is not particularly limited, but toner particles may be prepared by a wet method such as an emulsion aggregating method and a dissolution suspension method from the viewpoint of preventing a metallic pigment from being exposed on the surface of the toner.

Emulsification Aggregation

In the exemplary embodiment, usable is an emulsion aggregating method in which the shape and particle diameter of toner particles are easily controlled and a control range of a structure of toner particles, such as a core-shell structure, is wide.

Hereinafter, a method of preparing toner particles with the emulsion aggregating method will be described in detail.

The emulsion aggregating method includes an emulsification process of emulsifying the raw material for constituting the toner particles to form various dispersions such as resin particle (emulsified particle) dispersion, an aggregation process of forming aggregates of the resin particles, and a coalescence process of coalescing the aggregates.

Hereinafter, each process of the emulsion aggregating method will be described.

Emulsification Process

A resin particle dispersion may be prepared by applying a shearing force to a solution in which an aqueous medium and a binder resin are mixed in a disperser, to thereby perform emulsification, as well as by using an well-known polymerization methods such as emulsification polymerization method, a suspension polymerization method and a dispersion polymerization method. At this time, particles may be formed by heating a resin component to lower the viscosity thereof. In addition, in order to stabilize the dispersed resin particles, a dispersant may be used. Furthermore, when resin is dissolved in an oil solvent having relatively low solubility in water, the resin is dissolved in the solvent and particles thereof are dispersed in water with a dispersant and a polymer electrolyte, followed by heating and reduction in pressure to evaporate the solvent. As a result, the resin particle dispersion is prepared.

Examples of the aqueous medium include water such as distilled water or ion exchange water; and alcohols, and water is preferable.

In addition, examples of the dispersant which is used in the emulsification process include a water-soluble polymer such as polyvinyl alcohol, methyl cellulose, ethyl cellulose, hydroxyethyl cellulose, carboxymethyl cellulose, sodium polyacrylate, or sodium polymethacrylate; a surfactant such as an anionic surfactant (for example, sodium dodecylbenzenesulfonae, sodium octadecylsulfate, sodium oleate, sodium laurate, or potassium stearate), a cationic surfactant (for example, laurylamine acetate, stearylamine acetate, or lauryltrimethylammonium chloride), a zwitterionic surfactant (for example, lauryl dimethylamine oxide), or a nonionic surfactant (for example, polyoxyethylene alkyl ether, polyoxyethylene alkyl phenyl ether, or polyoxyethylene alkylamine); and an inorganic salt such as tricalcium phosphate, aluminum hydroxide, calcium sulfate, calcium carbonate, or barium carbonate.

Examples of the disperser which is used for the emulsification process include a homogenizer, a homomixer, a pressure kneader, an extruder, and a media disperser.

With regard to the size of the resin particles being contained in the dispersion, the average particle diameter (volume average particle diameter) thereof is preferably less than or equal to 1.0 μm, more preferably from 60 nm to 300 nm, and still more preferably from 150 nm to 250 nm.

When the volume average particle diameter thereof is greater than or equal to 60 nm, the resin particles are likely to be unstable in the dispersion and thus the aggregation of the resin particles may be easy. In addition, when the volume average particle diameter thereof is less than or equal to 1.0 μm, the particle diameter distribution of the toner particles may be narrowed.

When a release agent dispersion is prepared, a release agent is dispersed in water with an ionic surfactant and a polyelectrolyte such as a polyacid or a polymeric base and the resultant is heated at a temperature higher than or equal to the melting point of the release agent, followed by dispersion using a homogenizer with which strong shearing force is applied or a pressure extrusion type disperser. Through the above-described process, a release agent dispersion is obtained. During the dispersion, an inorganic compound such as polyaluminum chloride may be added to the dispersion. Preferable examples of the inorganic compound include polyaluminum chloride, aluminum sulfate, high basic polyaluminum chloride (BAC), polyaluminum hydroxide, and aluminum chloride. Among these, polyaluminum chloride and aluminum sulfate are preferable.

The release agent dispersion is used in the emulsion aggregating method, but may also be used when the toner is prepared in the suspension polymerization method.

Through the dispersion, the release agent dispersion having release agent particles with a volume average particle diameter of 1 μm or less is obtained. It is more preferable that the volume average particle diameter of the release agent particles be from 100 nm to 500 nm.

When the volume average particle diameter is greater than or equal to 100 nm, although also being affected by properties of the binder resin to be used, in general, it is easy to mix a release agent component into toner particles. In addition, when the volume average particle diameter is less than or equal to 500 nm, the dispersal state of the release agent in the toner particles may be satisfactory.

When a metallic particle dispersion is prepared, a well-known dispersion method may be used. For example, general dispersion units such as a rotary-shearing homogenizer, a ball mill, a sand mill, and a dyno mill, which have a medium, or an ultimizer are used, and the dispersion method is not limited thereto.

The metallic particles are dispersed in water with an ionic surfactant and a polyelectrolyte such as a polyacid or a polymeric base. The volume average particle diameter of the dispersed metallic particles may be less than or equal to 20 μm. However, the volume average particle diameter of the dispersed metallic particles is preferably in a range of from 3 μm to 16 μm because the dispersion of the metallic particles in the toner is good without impairing aggregability.

The metallic particles and the binder resin may be dispersed and dissolved in a solvent and mixed, and the resultant may be dispersed in water through phase inversion emulsification or shearing emulsification, thereby preparing a dispersion of the metallic particles coated with the binder resin.

Aggregation Process

In the aggregation process, a mixture of a resin particle dispersion, a metallic particle dispersion and a release agent dispersion is heated to a temperature equal to or lower than the glass transition temperature of the resin particle to aggregate the mixed particles, thus forming aggregated particles. The formation of the aggregated particles is frequently performed by adjusting the pH of the mixture to an acidic state with stirring. The pH is preferably in a range of from 2 to 7. In this case, it is also effective to use a coagulant.

Further, in the aggregation process, the release agent dispersion may be added and mixed at once together with various dispersions such as a resin particle dispersion, and may also be added in several portions.

As the coagulant, a surfactant having a reverse polarity to that of a surfactant which is used as the dispersant, an inorganic metal salt, and a divalent or higher valent metal complex may be preferably used. In particular, the metal complex is particularly preferably used because the amount of the surfactant used may be reduced and charging characteristics are improved.

Preferable examples of the inorganic metal salt as the coagulant include an aluminum salt and a polymer thereof. In order to obtain a narrower particle diameter distribution, a divalent inorganic metal salt is preferable to a monovalent inorganic metal salt, a trivalent inorganic metal salt is preferable to a divalent inorganic metal salt, and a tetravalent inorganic metal salt is preferable to a trivalent inorganic metal salt. Even in a case of inorganic metal salts having the same valence, a polymeric type of inorganic metal salt polymer is more preferable.

In the exemplary embodiment, in order to obtain a narrower particle diameter distribution, a tetravalent inorganic metal salt polymer containing aluminum is preferably used.

After the aggregated particles have desired particle diameters, the resin particle dispersion is additionally added (coating process). According to this, a toner having a configuration in which the surfaces of core aggregated particles are coated with resin may be prepared. In this case, the release agent and the metallic particles are not easily exposed to the surface of the toner, which is preferable from the viewpoints of charging characteristics and developability. In a case of additional addition, a coagulant may be added or the pH value may be adjusted before additional addition.

Coalescence Process

In the coalescence process, under stirring conditions based on those of the aggregation process, by increasing the pH value of a suspension of the aggregated particles to be in a range of from 3 to 9, the aggregation is stopped. By performing heating at the glass transition temperature or higher of the resin, the aggregated particles are coalesced.

In addition, when the surface of the core aggregated particles is coated with a resin in the aggregation process, the resin is also coalesced and coats the core aggregated particles. The heating time may be determined so as to achieve coalescence and may be approximately from 0.5 hour to 10 hours.

After coalescing, cooling is carried out to obtain coalesced particles. In addition, in a cooling process, a cooling rate may be reduced around the glass transition temperature of the resin (the range of the glass transition temperature ±10° C.), that is, slow cooling may be carried out to promote crystallization.

The coalesced particles, which are obtained by coalescing, may be subjected to a solid-liquid separation process such as filtration, or as necessary, a cleaning process and drying process to obtain toner particles.

If desired, an external additive may be added to the toner particles which are obtained by subjecting to respective processes for the emulsion aggregation process as described later.

Dissolution Suspension Method

Next, the preparation method of toner particles by a dissolution suspension method will be described in detail.

The dissolution suspension method is a method in which a material containing a binder resin, metallic particles and other components such as a release agent, which is used as necessary, is dissolved or dispersed in a solvent that enables the binder resin to be dissolved, the obtained liquid is then added in an aqueous medium containing an inorganic dispersant to cause dispersion suspension, thereby performing the granulation, and thereafter the solvent is removed to thereby obtain toner particles.

Examples of the other components which are used in the dissolution suspension method include an internal additive, a charge-controlling agent, and organic particles, in addition to a release agent.

In the exemplary embodiment, the binder resin, the metallic particles and the other components, which are used as necessary, are dissolved or dispersed in a solvent that enables the binder resin to be dissolved.

It is determined whether or not the solvent enables the binder resin to be dissolved depending on structural components of the binder resin, a molecular chain length, a degree of three-dimensional chemical structure or the like. In general, examples of the solvent include hydrocarbons such as toluene, xylene, and hexane; halogenated hydrocarbons such as methylene chloride, chloroform, dichloroethane, and dichloroethylene; alcohols or ethers such as ethanol, butanol, benzyl alcohol ethyl ether, benzyl alcohol isopropyl ether, tetrahydrofuran, and tetrahydropyran; esters such as methyl acetate, ethyl acetate, butyl acetate, and isopropyl acetate; ketones or acetals such as acetone, methyl ethyl ketone, diisobutyl ketone, dimethyl oxide, diacetone alcohol, cyclohexanone, and methylcyclohexanone.

The above-described solvents dissolve binder resins and it is not necessary for the solvents to dissolve the metallic particles and other components. The metallic particles and the other components may be dispersed in the binder resin dispersion.

The amount of the solvent used is not limited as long as the viscosity thereof enables the solvent to allow granulation in an aqueous medium. The ratio of the material containing the binder resin, the metallic particles and other components (the former) to the solvent (the latter) is preferably 10/90 (weight ratio of the former to the latter) to 50/50, from the viewpoint of easy granulation and final yield of toner particles.

The liquid (mother liquid of toner) in which the binder resin, the metallic particles and other components are dissolved or dispersed in a solvent is granulated such that the particle diameter thereof is a predetermined particle diameter in an aqueous medium containing an inorganic dispersant. Water is mainly used for the aqueous medium. The mixing ratio (weight ratio) of the aqueous medium and the mother liquid of toner is preferably 90/10 (aqueous medium/mother liquid of toner) to 50/50.

The inorganic dispersant is preferably selected from tricalcium phosphate, hydroxyapatite, calcium carbonate, titanium oxide, and silica powder.

The amount of the inorganic dispersant used is determined depending on the particle diameter of particles to be granulated. However, in general, the use amount thereof is preferably in a range of from 0.1% by weight to 15% by weight, with respect to the mother liquid of toner. When the used amount thereof is not less than 0.1% by weight, it is easy to perform a satisfactory granulation. When the use amount thereof is 15% by weight or less, unnecessary fine particles are hardly formed. According to this, it is apt to obtain desired particles with high yield.

In order to perform good granulation from the mother liquid of toner, an auxiliary agent may be added to an aqueous medium containing an inorganic dispersant.

Examples of the auxiliary agent include well-known cationic, anionic and nonionic surfactants, and the anionic surfactant is particularly preferable. Examples of anionic surfactant include sodium alkylbenzene sulfonate, sodium α-olefinsulfonate, and sodium alkylsulfonate. The amount of these examples used is preferably in a range of from $1\times10^{-4}$% by weight to 0.1% by weight, with respect to the mother liquid of toner.

The granulation from the mother liquid of toner in an aqueous medium containing an inorganic dispersant is preferably carried out under shearing.

The granulation of the mother liquid of toner which is dispersed in an aqueous medium is carried out such that the average particle diameter thereof is preferably less than or equal to 20 μm. Particularly, the average particle diameter thereof is preferably from 3 μm to 15 μm.

As a device including a shearing mechanism, various dispersers are exemplified. Among these, a homogenizer is preferable. By using a homogenizer, substances which are incompatible with each other (in the exemplary embodiment, the aqueous medium containing an inorganic dispersant and the mother liquid of toner) are made to pass through a gap between a casing and a rotating rotor. Therefore, a substance, which is incompatible with liquid, is particle-dispersed in the liquid.

Examples of the homogenizer include a TK homomixer, a line flow homomixer, an Auto-homomixer (all described above are manufactured by Tokushukika Kogyo K.K.), a SILVERSON homogenizer (manufactured by Silverson) and a POLYTRON homogenizer (manufactured by KINEMATICA AG).

A stirring condition using a homogenizer is preferably 2 m/sec or more in the circumferential speed of rotor blades. When the stirring condition is not less than 2 m/sec, the granulation tends to be sufficient.

The granulation is performed as described above, and thereafter the solvent is removed.

The solvent may be removed under the conditions of room temperature (25° C.) and normal pressure. However, since it takes a long time to remove, it is preferable that the removal of the solvent be carried out under a temperature condition in which a temperature is lower than a boiling point of the solvent and the difference between the temperature and the boiling point is less than or equal to 80° C. The pressure may be normal pressure or reduced pressure, but in a case of reduced pressure, the removal of the solvent is carried out under a reduced pressure of preferably from 20 mmHg to 150 mmHg.

The toner according to the exemplary embodiment may preferably be washed with hydrochloric acid or the like after removing the solvent. According to this, an inorganic dispersant remaining on the surface of toner particles is removed and then the composition of toner particles returns to the original composition thereof, thereby improving characteristics of toner particles.

Furthermore, when dehydration and drying are performed, it is possible to obtain toner particle powder.

If desired, an external additive may be added to the toner particles which are obtained by subjecting to respective processes for the dissolution suspension method as described later.

Addition of External Additive

Process of External Addition

In order to adjust charging, impart fluidity, and impart a charge exchange property, inorganic oxides or the like which are represented by silica, titania, and alumina may be added and attached to the toner particles obtained by the above-mentioned process, as an external additive.

The above-described processes may be performed with a V-shape blender, a HENSCHEL mixer, a LÖEDIGE mixer or the like and the attachment is performed in plural steps.

The amount of the external additive added is preferably in a range of from 0.1 part to 5 parts and more preferably in a range of from 0.3 parts to 2 parts, with respect to 100 parts of the toner particles.

In addition to the above-described inorganic oxides or the like, other components (particles) such as a charge-controlling agent, organic particles, a lubricant, and an abrasive may be added as an external additive.

The charge-controlling agent is not particularly limited, and a colorless or light-color material is preferably used. Examples thereof include quaternary ammonium salt compounds, nigrosine compounds, a complex of aluminum, iron, chromium, or the like, and triphenylmethane pigments.

Examples of the organic particles include particles of vinyl resins, polyester resins, silicone resins, and the like, which are generally used for surfaces of toner particles as the external additive. In addition, the organic particles and inorganic particles are used as a flow auxiliary agent, a cleaning aid, or the like.

Examples of the lubricant include fatty acid amides such as ethylene bis stearamide and oleamide; and fatty acid metal salts such as zinc stearate and calcium stearate.

Examples of the abrasive include the above-described silica, alumina, and cerium oxide.

Sieving Process

Further, after the external addition process, if necessary, a sieving process may be provided. Specific examples of sieving include a gyro-shifter, a vibration sieving machine, and a wind classifier.

Through the sieving process, coarse particles of external additives are removed, and thus the occurrence of streaks on a photoreceptor and the contamination in the apparatus are prevented.

As described above, the toner according to the exemplary embodiment is obtained.

2. Toner Cartridge, Process Cartridge, Image Forming Apparatus, and Image Forming Method.

Subsequently, a toner cartridge, a process cartridge, an image forming apparatus, and an image forming method according to the exemplary embodiment will be collectively described.

An image forming apparatus/image forming method according to the exemplary embodiment are described.

The image forming apparatus according to the exemplary embodiment includes: an image holding member; a charging unit for charging the image holding member, an exposure unit for exposing the charged image holding member to light to form an electrostatic latent image on the surface of the image holding member; a developing unit for developing the electrostatic latent image with a developer containing a toner to form a toner image; a transfer unit for transferring the toner image from the image holding member to the surface of a transfer medium; and a fixing unit for fixing the toner image transferred to the surface of the transfer medium. Here, as the developer, the electrostatic charge image developer according to the exemplary embodiment is applied.

In the image forming apparatus according to the exemplary embodiment, an image forming method (image forming method according to the exemplary embodiment) including: a latent image forming process of forming an electrostatic latent image on the surface of an image holding member; a developing process of developing the electrostatic latent image formed on the surface of the image holding member with a developer containing a toner to form a toner image; a transferring process of transferring the toner image to the surface of a transfer medium; and a fixing process of fixing the toner image transferred to the surface of the transfer medium, is carried out. Here, as the developer, the electrostatic charge image developer according to the exemplary embodiment is applied.

As the image forming apparatus according to the exemplary embodiment, known image forming apparatuses such as a direct transfer type image forming apparatus which directly transfers a toner image formed on the surface of an image holding member onto a recording medium; an intermediate transfer type image forming apparatus which primarily transfers a toner image formed on the surface of an image holding member onto the surface of an intermediate transfer member and secondarily transfers the toner image transferred on the surface of the intermediate transfer member onto the surface of a recording medium; an image forming apparatus including a cleaning unit which cleans the surface of an image holding member and after a toner image is transferred and before charging; and an image forming apparatus including an erasing unit which erases a charge from the surface of an image holding member after a toner image is transferred and before charging by irradiating the surface with erasing light may be used.

In the case of the intermediate transfer type image forming apparatus, for example, a transfer unit includes an intermediate transfer member to the surface of which a toner image is transferred, a primary transfer unit which primarily transfers the toner image formed on the surface of the image holding member onto the surface of the intermediate transfer member, and a secondary transfer unit which secondarily transfers the toner image transferred onto the surface of the intermediate transfer member onto the surface of a recording medium.

In the image forming apparatus according to the exemplary embodiment, for example, the portion including the developing unit may also be a cartridge structure (process cartridge) that is detachable from the image forming apparatus.

As such a process cartridge, for example, the process cartridge according to the exemplary embodiment, which is configured to accommodate the electrostatic charge image developer of the exemplary embodiment, includes a developing unit for developing the electrostatic charge image formed on the surface of the image holding member with this electrostatic charge image developer to form the toner image, and is detachable from the image forming apparatus, is suitably used.

The process cartridge may include a developer holding member for holding and supplying the electrostatic charge image developer and a container that accommodates the electrostatic charge image developer.

Further, the process cartridge according to the exemplary embodiment is not limited to the above configuration, and, if necessary, may be configured to include, in addition to the developing unit, at least one selected from other units such as an image holding member, a charging unit, an electrostatic charge image forming unit, and a transfer unit.

In addition, in the image forming apparatus according to the exemplary embodiment, the container portion accommodating the toner according to the exemplary embodiment, as a refilling toner supplied to the developing unit, may also be a cartridge structure (toner cartridge) that is detachable from the image forming apparatus. A developer cartridge containing a container that accommodates the developer may be used.

As such a process cartridge, for example, the toner cartridge according to the exemplary embodiment, which is configured to accommodate the toner according to the exemplary embodiment and is detachable from the image forming apparatus, is suitably used.

Hereinafter, the image forming apparatus according to the exemplary embodiment will be described with reference to the accompanying drawings.

FIG. 1 is a schematic configuration view showing an example of the image forming apparatus according to the exemplary embodiment. The image forming apparatus according to the exemplary embodiment relates to a tandem type image forming apparatus configured such that a plurality of photoreceptors, that is, a plurality of image forming units are provided as image holding members.

As shown in FIG. 1, the image forming apparatus according to the exemplary embodiment is configured such that four image forming units 50Y, 50M, 50C, and 50K for respectively forming toner images of yellow, magenta, cyan and black colors, and an image forming unit 50B for forming a brilliant image are arranged in parallel (in tandem) to each other at regular intervals. Such image forming units are arranged in order of the image forming units 50Y, 50M, 50C, 50K, and 50B from the upstream side in a rotation direction of an intermediate transfer belt 33.

Here, each of the image forming units 50Y, 50M, 50C, 50K, and 50B has the same configuration except for the color of a toner in the accommodated developer. Therefore, here, the image forming unit 50Y for forming a yellow image will be described as a representative below. In addition, descriptions of the image forming units 50M, 50C, 50K, and 50B will be omitted by applying the reference symbols of magenta (M), cyan (C), black (K), silver (B) instead of yellow (Y) to the same portions as the image forming unit 50Y.

The yellow image forming unit 50Y is provided with a photoreceptor 21Y as an image holding member, and the photoreceptor 21Y is configured to be rotatably driven by a driving unit (not shown) along the direction of arrow A shown in FIG. 1 at a predetermined process speed. As the photoreceptor 21Y, an organic photoreceptor having sensitivity in the infrared region is used.

On the upper portion of the photoreceptor 21Y, a charging roll (charging unit) 28Y is provided. A predetermined voltage is applied to the charging roll 28Y by a power source (not shown) to allow the surface of the photoreceptor 21Y to be charged in a predetermined potential.

An exposure device (electrostatic charge image forming unit) 19Y for exposing the surface of the photoreceptor 21Y to light to form an electrostatic charge image is disposed around the photoreceptor 21Y at the downstream of the charging roll 28Y in the rotating direction of the photoreceptor 21Y. Here, as the exposure Y, because of space limitations, an LED array for realizing miniaturization is used. However, this exposure device 19Y is not limited thereto, and there is no problem even when other electrostatic charge image forming units using laser beam are used.

Further, a developing device (developing unit) 20Y accommodating a yellow developer is disposed around the photoreceptor 21Y at the downstream of the exposure device 19Y in the rotating direction of the photoreceptor 21Y. The developing device 20Y configured to form a toner image on the surface of the photoreceptor 21Y by developing the electrostatic charge image formed on the surface of the photoreceptor 21Y with a yellow toner.

An intermediate transfer belt (primary transfer unit) 33 for primarily transferring the toner image formed on the surface of the photoreceptor 21Y is disposed under the photoreceptor 21Y such that it extends over lower sides of the five photoreceptors 21Y, 21M, 21C, 21K, and 21B. This intermediate transfer belt 33 is configured to be pressed against the surface of the photoreceptor 21Y by a primary transfer roll 17Y. In addition, the intermediate transfer belt 33 is configured to be supported by three rolls of a drive roll 22, a support roll 23 and a bias roll 24 to be moved at a moving speed equal to the process speed of the photoreceptor 21Y in the direction of arrow B. A yellow toner image is primarily transferred to the surface of the intermediate transfer belt 33, and then toner images having respective colors, such as magenta, cyan, black, and silver (brilliance), are sequentially and primarily transferred thereto to be laminated.

Further, a cleaning device 15Y for cleaning the toner remaining on or retransferred to the surface of the photoreceptor 21Y is disposed around the photoreceptor 21Y at the downstream of the primary transfer roll 17Y in the rotating direction (direction of arrow A) of the photoreceptor 21Y. In the cleaning device 15Y, a cleaning blade is mounted to be pressed in a counter direction to the surface of the photoreceptor 21Y.

A secondary transfer roll (secondary transfer unit) 34 is pressed against the bias roll 24 supporting the intermediate transfer belt 33 through the intermediate transfer belt 33. In the pressure-contact portion of the bias roll 24 and the secondary transfer roll 34, the toner image primarily transferred and laminated on the surface of the intermediate transfer belt 33 is electrostatically transferred to the surface of a recoding paper (recording medium) P supplied from a paper cassette (not shown). In this case, since a silver toner image is a top layer (uppermost layer) in the toner image transferred and laminated onto the intermediate transfer belt 33, the silver toner image is a bottom layer (lowermost layer) in the toner image transferred to the surface of the recording paper P.

Further, a fixing device (fixing unit) 35 for fixing the toner image multi-transferred onto the recording paper P to the surface of the recording paper P by heat and pressure to convert the toner image into a permanent image is disposed at the downstream of the secondary transfer roll 34.

Here, as the fixing device 35, for example, a fixing belt having a belt shape, the surface of which is made of a low surface energy material typified by a fluorine resin component or a silicone resin, and a cylindrical fixing roll, the surface of which is made of a low surface energy material typified by a fluorine resin component or a silicone resin, are exemplified.

Next, operations of the image forming units 50Y, 50M, 50C, 50K and 50B for respectively forming toner images of yellow, magenta, cyan, black, and silver (brilliance) colors will be described. Since the operations of the image forming units 50Y, 50M, 50C, 50K and 50B are similar to each other, the operation of the yellow image forming unit 50Y will be described as a representative.

In the yellow image forming unit 50Y, the photoreceptor 21Y rotates at a predetermined process speed in the direction of arrow A. The surface of the photoreceptor 21Y is negatively charged by the charging roll 28Y in a predetermined potential. Thereafter, the surface of the photoreceptor 21Y is exposed to light by the exposure device 19Y to form an electrostatic charge image corresponding to image information. Subsequently, the negatively-charged toner is reversely developed by the developing device 20Y, and the electrostatic charge image formed on the surface of the photoreceptor 21Y is visualized on the surface of the photoreceptor 21Y, to thereby forma toner image. Thereafter, the toner image formed on the surface of photoreceptor 21Y is primarily transferred to the surface of the intermediate transfer belt 33 by the primary transfer roll 17Y. After the primary transfer, the photoreceptor 21Y is cleaned such that a transfer residual component, such as toner remaining on the surface of the photoreceptor 21Y, is scraped off by a cleaning blade of the cleaning device 15Y, and then is prepared for the next image forming process.

The above operation is performed by each of the image forming units 50Y, 50M, 50C, 50K and 50B, and the toner image visualized on the surface of each of the photoreceptors 21Y, 21M, 21C, 21K, and 21B is sequentially multi-transferred to the surface of the intermediate transfer belt 33. In color mode, the color toner images are multi-transferred in order of yellow, magenta, cyan, black, and silver (brilliance), but, even in two-color or three-color mode, only the toner images of desired colors are singly-transferred or multi-transferred in this order. Thereafter, the toner image singly-transferred or multi-transferred to the surface of the intermediate transfer belt 33 is secondarily transferred to the surface of the recording paper P supplied from the paper cassette (not shown) by the secondary transfer roll 34, and is subsequently heated and pressed in the fixing device 35 to be fixed on the recording paper P. After the secondary transfer, the toner remaining on the surface of the intermediate transfer belt 33 is cleaned by a belt cleaner 26 provided with a cleaning blade for the intermediate transfer belt 33.

Further, the yellow image forming unit 50Y is configured such that the developing device 20Y accommodating a yellow developer, the photoreceptor 21Y, the charging roll 28Y, and the cleaning device 15Y are integrated with each other, and is thus configured as a process cartridge detachable from the main part of the image forming apparatus. Further, each of the image forming units 50B, 50K, 50C, and 50M, similarly to the image forming unit 50Y, is also configured as a process cartridge.

Further, each of the toner cartridges 40Y, 40M, 40C, 40K, and 40B accommodates a toner of each color in the container, is detachable from the image forming apparatus, and is connected with the developing device corresponding to each color through a toner supply pipe (not shown). Further, when the toner contained in each toner cartridge runs low, this toner cartridge is replaced.

EXAMPLES

Hereinafter, the exemplary embodiment will be described in more detail with reference to Examples and Comparative Examples below, but is not limited to Examples below. Here, "parts" and "%" are based on weight, unless specified otherwise.

Measurement Method

Particle Diameter of Ferrite and Carrier

The average particle diameter of carriers or ferrite particles constituting the core refers to a value measured using a laser diffraction/scattering particle size distribution analyzer (LS Particle Size Analyzer: LS13 320, manufactured by Beckman-Coulter Inc.). The cumulative distribution by volume is drawn from the smallest particle diameter side with respect to the particle size range (channel) divided based on the obtained particle size distribution, and the particle diameter corresponding to a cumulative vale of 50% refers to the volume average particle diameter (D50).

Resistance of Carrier

Two polar plates face each other in parallel with a width of 1 mm (i.e., the gap between the plates: 1 mm), 0.25 g of the magnetic particles are put therebetween, the two polar plates are held by a magnet having a cross-sectional area of 2.4 $cm^2$, a voltage of 100 V is applied, and a current value is measured. At this time, the electric field is 2,400 V/cm. The resistance value is calculated from the obtained current value.

Further, with an applied voltage of 800 V, an electric field of 19,200 V/cm is generated. In this case, the resistance value is calculated as well.

Resistance of Metallic Particles

A container having a cross-sectional area of $2\times10^{-4}$ $m^2$ is filled with metallic particles at room temperature and normal humidity (temperature: 20° C., relative humidity (RH): 50%) such that the thickness thereof is about 1 mm, and then a load of $1\times10^4$ $kg/m^2$ is applied to the filled metallic particles by a metal member. A voltage is applied between the metal member and the bottom electrode of the container such that an electric field of 10,000 V/cm is generated, and the value calculated from the current value at this time refers to a volume electric resistance value.

Toner Particle Diameter

The method of measuring the volume average particle diameter of a toner particle is as follows. 0.5 mg to 50 mg of a measurement sample is put into 2 ml of an aqueous solution containing a surfactant as a dispersant (electrolytic solution), preferably, sodium alkylbenzene sulfonate, in an amount of 5 weight %, and this resultant is added to 100 ml to 150 ml of the electrolytic solution. The electrolytic solution in which this sample is suspended is subjected to dispersion treatment for about 1 minute by an ultrasonic dispersion device, and the particle size distribution of particles having a particle diameter of from 2.0 μm to 60 μm is measured using an aperture having an aperture diameter of 100 μm by the COULTER MULTISIZER II (manufactured by Beckman-Coulter Corporation). The number of particles used in the measurement of the particle size distribution is set to 50,000.

The cumulative distribution by volume is drawn from the smallest particle diameter side with respect to the particle size range (channel) divided based on the obtained particle size distribution, and the particle diameter corresponding to a cumulative vale of 50% refers to the volume average particle diameter (D50).

Surface Shape of Ferrite Particle

As the method of measuring surface roughness Ry (maximum height) and surface roughness Sm (average interval of irregularities), a method is used in which the surface roughness Ry and the surface roughness Sm are obtained by observing surfaces of 50 carriers at a magnification of 3,000 times using an ultra-deep color 3D profile measuring microscope (VK-9500, manufactured by Keyence Corporation).

The maximum height Ry is calculated by obtaining a roughness curve, extracting only a reference length in the direction of the average line of the roughness curve and then obtaining the sum (Yp+Yv) of the height Yp from the average line of this extracted portion to the highest mountain top and the depth Yv from the average line of this extracted portion to the lowest valley bottom. Here, at the time of obtaining the maximum height Ry, the reference length is 10 μm, and the cut-off value is 0.08 mm. The Sm (average interval of unevenness) is calculated by obtaining a roughness curve and the obtaining the average value of mountain-valley period intervals from the intersection point at which the roughness curve intersects with the average line. At the time of obtaining the Sm (average interval of unevenness), the reference length is 10 μm, and the cut-off value is 0.08 mm. The measurement of this surface roughness is performed according to JIS B 0601 (edited in 1994).

Preparation of Metallic Particle

Metallic Particle 1

First Coating 154 parts of aluminum pigment (item number: 2173, manufactured by Showa Aluminum Corporation) is added to 500 parts of methanol, followed by stirring at 60° C. for 1.5 hours, to thereby obtain a slurry. Then, ammonia is added to the obtained slurry to have a pH of 8.0. Then, 10 parts of tetraethoxysilane is added to this pH-adjusted slurry, and stirred and mixed at 60° C. for 5 hours. Subsequently, the obtained slurry is filtered, dried at 110° C. for 3 hours, thereby obtaining aluminum particles coated with silica.

Second Coating

Subsequently, 500 parts of mineral spirit is added to the obtained aluminum particles, and the obtained mixture is heated to 80° C. while blowing nitrogen gas. Then, 0.5 parts of methacrylic acid, 9.4 parts of epoxidized polybutadiene, 5 parts of tripropylene glycol diacrylate, 7 parts of trimethylol propane triacrylate, 4.2 parts of divinyl benzene, and 1.8 parts of azobisisobutyronitrile are added thereto, and the resultant is polymerized at 80° C. for 5 hours, to thereby obtain a coated material.

Subsequently, the obtained coated material is filtered, and dried at 150° C. for 3 hours, to thereby obtain metallic particle 1.

The resistance of the obtained metallic particle in an electric field of 10,000 V/cm is $10^{11}$ Ωcm.

Metallic Particle 2

First Coating

Aluminum particles coated with silicate are prepared in the same manner as in the preparation of the first coating of the metallic particle 1.

Second Coating

Metallic particle 2 is obtained in the same manner as in the preparation of the second coating of the metallic particle 1, except that 9 parts of epoxidized polybutadiene, 4 parts of tripropylene glycol diacrylate, 6 parts of trimethylol propane triacrylate, 3.9 parts of divinyl benzene, and 1.6 parts of azobisisobutyronitrile are used.

The resistance of the obtained metallic particle in an electric field of 10,000 V/cm is $10^{10}$ Ωcm.

Metallic Particles 3, 4, and 5

Metallic particles 3, 4, and 5 are obtained in the same manner as in the preparation of the metallic particle 1, except that the amount of tetraethoxysilane used in the first coating, the amount of monomer used in the second coating, and the amount of initiator used in the second coating are changed as indicated in Table 1 below.

The resistances of the obtained metallic particles in an electric field of 10,000 V/cm are also given below.

TABLE 1

| | First coating layer | | Second coating layer | | | | | | Resistance in electric field of |
|---|---|---|---|---|---|---|---|---|---|
| | Aluminum pigment (part) | TESi (part) | MA (part) | EPBD (part) | TPG-Ac (part) | TMP-Ac (part) | DVB (part) | AIBN (part) | 10,000 V/cm (Ωcm) |
| Metallic particle 1 | 154 | 10 | 0.5 | 9.4 | 5 | 7 | 4.2 | 1.8 | $10^{11}$ |
| Metallic particle 2 | 154 | 10 | 0.5 | 9 | 4 | 6 | 3.9 | 1.6 | $10^{10}$ |
| Metallic particle 3 | 154 | 11 | 0.6 | 9.6 | 6 | 6 | 4.2 | 1.8 | $10^{13}$ |
| Metallic particle 4 | 154 | 8 | 0.4 | 8.9 | 4 | 6 | 4 | 1.6 | $10^{9}$ |
| Metallic particle 5 | 154 | 12 | 0.8 | 10 | 6 | 6 | 4 | 1.9 | $10^{14}$ |

The components used in Table 1 are as follows.
TESi: tetraethoxysilane
MA: methacrylic acid
EPBD: epoxidized polybutadiene (manufactured by Nippon Soda Co., Ltd., JP-100)
TPG-Ac: tripropylene glycol diacrylate
TMP-Ac: trimethylol propane triacrylate
DVB: divinylbenzene
AIBN: azobisisobutyronitrile Preparation of Toner Toner 1

Synthesis of Binder Resin

| | |
|---|---|
| Dimethyl adipate: | 74 parts |
| Dimethyl terephthalate: | 192 parts |
| Bisphenol A ethylene oxide adduct: | 216 parts |
| Ethylene glycol: | 38 parts |
| Tetrabutoxytitanate (catalyst): | 0.037 parts |

The above components are put in a two-necked flask dried by heating, nitrogen gas is put into the container to maintain an inert gas atmosphere, and the temperature is raised under stirring. Thereafter, a copolycondensation reaction is caused at 160° C. for 7 hours, and then the temperature is raised to 220° C. while the pressure is slowly reduced to 10 Torr ($1.3\times10^3$ Pa), and the temperature is held for 4 hours. The pressure is temporarily released to normal pressure, and then 9 parts of trimellitic anhydride is added. The pressure is then slowly reduced again to 10 Torr ($1.3\times10^3$ Pa), and the temperature is held at 220° C. for an hour, thereby synthesizing a binder resin.

The glass transition temperature (Tg) of the binder resin is measured with a differential scanning calorimeter (manufactured by Shimadzu Corporation, DSC-50) according to ASTMD 3418-8 under the conditions of a temperature range from room temperature (25° C.) to 150° C. and a rate of temperature rise of 10° C./min. The glass transition temperature is defined as a temperature at the intersection between lines extending from a base line and a rising line in an endothermic portion. The glass transition temperature of the binder resin is 63.5° C.

Preparation of Resin Particle Dispersion

| | |
|---|---|
| Binder resin: | 160 parts |
| Ethyl acetate: | 233 parts |
| Aqueous sodium hydroxide solution (0.3N): | 0.1 parts |

The above components are put in a separable flask, followed by heating at 70° C., and the resultant is stirred with a Three-One motor (manufactured by Shinto Scientific Co., Ltd.), thereby preparing a resin mixture solution. While this resin mixture solution is further stirred at 90 rpm, 373 parts of ion exchange water is slowly added thereto to cause phase inversion emulsification, and the solvent is removed, thereby obtaining a resin particle dispersion (solid content concentration: 30%).

Preparation of Release Agent Dispersion

| | |
|---|---|
| Carnauba wax (manufactured by TOA KASEI CO., LTD., RC-160): | 50 parts |
| Anionic surfactant (manufactured by DAI-ICHI KOGYO SEIYAKU CO., LTD., NEOGEN SC): | 1.0 part |
| Ion exchange water: | 200 parts |

The above components are mixed and heated to 95° C., and dispersed using a homogenizer (manufactured by IKA, Ultra TURRAX T50). Thereafter, the resultant is dispersed for 360 minutes by using a Manton-Gaulin high pressure homogenizer (manufactured by Gaulin Corporation), thereby preparing a release agent dispersion (solid content concentration: 20%) in which release agent particles are dispersed.

Preparation of Metallic Particle Dispersion

| | |
|---|---|
| Metallic particle 1: | 100 parts |
| Anionic surfactant (manufactured by DAI-ICHI KOGYO SEIYAKU CO., LTD., NEOGEN SC): | 1.5 parts |
| Ion exchange water: | 900 parts |

The above components are mixed, and dispersed using an emulsification dispersing machine CAVITRON (manufactured by Pacific Machinery & Engineering Co., Ltd., CR1010) for 1 hour, to thereby prepare a metallic particle dispersion (solid content concentration: 10%) in which metallic pigment (aluminum pigment) is dispersed.

Preparation of Toner

| | |
|---|---|
| Metallic particle dispersion: | 400 parts |
| Resin particle dispersion: | 375 parts |
| Release agent dispersion: | 50 parts |

The above components are put into a cylindrical stainless steel container, followed by dispersion and mixing for 10 minutes with a homogenizer (manufactured by IKA, ULTRA-TURRAX T50) while applying a shearing force at 4,000 rpm. Next, 1.75 parts of 10% nitric acid aqueous solution of polyaluminum chloride as a coagulant is slowly added dropwise, followed by dispersing and mixing with the homogenizer at 5,000 rpm for 15 minutes. As a result, a raw material dispersion is obtained.

Thereafter, the raw material dispersion is put into a polymerization kettle which includes a stirring device using a two-paddle stirring blade for generating a laminar flow and a thermometer, followed by heating with a mantle heater under stirring at 1,000 rpm to promote the growth of aggregated particles at 54° C. At this time, the pH value of the raw material dispersion is adjusted to a range of from 2.2 to 3.5 using 0.3 N nitric acid and 1 N sodium hydroxide aqueous solution. The resultant is held in the above-described pH value range for about 2 hours and aggregated particles are formed. At this time, the volume average particle diameter of the aggregated particles which is measured using a MULTISIZER II (aperture diameter: 50 μm, manufactured by Beckman Coulter, Inc.) is 10.4 μm.

Next, 125 parts of the resin particle dispersion is further added thereto so that the resin particles of the binder resin are allowed to adhere to the surfaces of the aggregated particles. The temperature is further raised to 56° C., and the aggregated particles are adjusted while observing the size and the forms of the particles with an optical microscope and a MULTISIZER II. Subsequently, in order to cause the aggregated particles to coalesce, the pH value is increased to 8.0 and then the temperature is raised to 67.5° C. After the coalescence of the aggregated particles is confirmed with the optical microscope, the pH value is decreased to 6.0 while maintaining the temperature of 67° C. After 1 hour, heating is stopped and the particles are cooled at a temperature decreasing rate of 1.0° C./min. The particles are then sieved through a 40 μm mesh, repeatedly washed with water, and then dried in a vacuum dryer. As a result, toner particles are obtained. The obtained toner particles have a volume average particle diameter of 12.2 μm.

1.5 parts of hydrophobic silica (manufactured by Nippon Aerosil Co., Ltd., RY50) and 1.0 part of hydrophobic titanium oxide (manufactured by Nippon Aerosil Co., Ltd., T805) are mixed and blended with 100 parts of the toner particles using a sample mill at 10,000 rpm for 30 seconds. Thereafter, the resultant is sieved with a vibration sieve having an aperture of 45 μm and thus a toner 1 is prepared.

Toners 2 to 5

Toners 2, 3, 4, and 5 are prepared in the same manner as in the preparation of toner 1, except that metallic particle is replaced by metallic particles 2, 3, 4, and 5, respectively.

Preparation of Carrier

Preparation of Coating Dispersion 1

| | |
|---|---|
| Cyclohexyl acrylate resin (weight average molecular weight: 50,000): | 36 parts by weight |
| Carbon black VXC72 (manufactured by Cabot Corporation): | 0.54 parts by weight |
| Toluene: | 250 parts by weight |
| Isopropyl alcohol: | 50 parts by weight |

The above components and glass beads (particle diameter: 1 mm, the amount thereof is the same as that of toluene) are put into a sand mill (manufactured by Kansai Paint Co., Ltd.), and stirred at a rotation speed of 1,200 rpm for 30 minutes, to thereby prepare a coating dispersion 1 having a solid content of 11%.

Coating Dispersions 2 to 4

Coating dispersion 2: coating dispersion 2 is prepared in the same manner as in the preparation of the coating agent 1, except that the amount of carbon black is changed to 0.61 parts by weight.

Coating dispersion 3: coating dispersion 3 is prepared in the same manner as in the preparation of the coating agent 1, except that the amount of carbon black is changed to 0.36 parts by weight.

Coating dispersion 4: coating dispersion 4 is prepared in the same manner as in the preparation of the coating agent 1, except that the amount of carbon black is changed to 0 parts by weight.

Preparation of Ferrite Particle

Ferrite Particle 1

1318 parts by weight of $Fe_2O_3$, 586 parts by weight of $Mn(OH)_2$, and 96 parts by weight of $Mg(OH)_2$ are mixed, and calcined at 900° C. for 4 hours. Then, the calcined product and 6.6 parts by weight of polyvinyl alcohol is put into water, and the resultant is pulverized and mixed with 0.5 parts by weight of polycarboxylic acid as a dispersant, 1 part by weight of $SiO_2$, and zirconia beads having a media diameter of 1 mm by a sand mill. The particle diameter of the obtained pulverized product is 1.5 μm. Then, the pulverized product is granulated and dried by a spray dryer such that the dry particle diameter thereof is 37 μm. Then, the obtained product is baked by an electric furnace in an oxygen-nitrogen mixed atmosphere of 1% oxygen partial pressure at 1,450° C. for 4 hours. Then, the baked product is further heated (post-adjusted) in the air at a temperature of 900° C. for 3 hours to obtain particles. The obtained particles are subjected to crushing and classifying processes, to thereby obtain ferrite particle 1.

The obtained ferrite particle has a particle diameter of 35 μm, a surface roughness Sm of 3.5 μm, and a maximum height Ry of 0.4 μm.

Ferrite Particles 2 to 7

Ferrite particles 2 to 7 are obtained in the same manner as in the preparation of the ferrite particle 1, except that the raw materials used, the particle diameter after wet pulverization, baking temperature, the oxygen partial pressure during the baking, and post-adjustment temperature are changed as indicated in Table 2 below. The particle diameter, surface roughness Sm, and maximum height Ry of the obtained ferrite particles are also given in Table 2 below.

TABLE 2

| | | Composition ratio | | | | Calcination temperature | D50 after wet pulverization | D50 after granulation/drying | Baking Temperature | Baking $O_2$ partial pressure | Post adjustment temperature | Physical properties D50 | Physical properties Sm | Physical properties Ry |
|---|---|---|---|---|---|---|---|---|---|---|---|---|---|---|
| | | $Fe_2O_3$ | $Mn(OH)_2$ | $Mg(OH)_2$ | $SiO_2$ | (° C.) | (μm) | (μm) | (° C.) | (%) | (° C.) | (μm) | (μm) | (μm) |
| Ferrite particle | 1 | 1,318 | 586 | 96 | 1 | 900 | 1.5 | 37 | 1,450 | 1 | 900 | 35 | 3.5 | 0.4 |
| | 2 | 1,318 | 586 | 96 | 1.1 | 900 | 1.2 | 37 | 1,350 | 1.5 | 800 | 35 | 2.0 | 0.7 |
| | 3 | 1,318 | 586 | 96 | 1.3 | 900 | 1.5 | 37 | 1,400 | 1 | 950 | 35 | 3.5 | 0.3 |
| | 4 | 1,318 | 588 | 96 | 1.1 | 900 | 1.2 | 37 | 1,380 | 1.5 | 900 | 35 | 2.0 | 0.6 |
| | 5 | 1,318 | 586 | 96 | 0 | 900 | 2.5 | 37 | 1,460 | 1 | 900 | 35 | 5.0 | 0.3 |
| | 6 | 1,318 | 586 | 96 | 0 | 900 | 1.8 | 37 | 1,420 | 1.6 | 920 | 35 | 3.0 | 0.9 |
| | 7 | 1,318 | 586 | 96 | 0 | 900 | 3.0 | 37 | 1,470 | 1.1 | 850 | 35 | 8.0 | 0.4 |

Preparation of Carrier

Carrier 1

2,000 g of ferrite particle 1 is put into a vacuum degassing type 5 L kneader, 545 g of coating dispersion 1 is added thereto, and while stirring the pressure is reduced to −200 mmHg (−26.6 kPa: gauge pressure) at 60° C. and these components are mixed for 15 minutes. Then, with heating and reducing the pressure, the mixture is stirred and dried at a temperature of 94° C. and a pressure of −720 mmHg (−96.0 kPa: gauge pressure) for 30 minutes to thereby obtain coated particles. Then, the obtained coated particles are sieved by a 75 μm mesh sieve net to thereby obtain carrier 1.

Carriers 2 to 7

Carriers 2 to 7 are obtained in the same manner as in the preparation of the carrier 1, except that ferrite particles used, coating dispersion used, and the coating amount of the coating dispersion are changed as indicated in Table 3 below.

TABLE 3

| | Ferrite particle | Coating dispersion | Coating resin | Coating amount | CB amount (vol) | Physical properties: Resistance in electric field of 19,200 V/cm (Ωcm) | Physical properties: Resistance ratio |
|---|---|---|---|---|---|---|---|
| Carrier 1 | 1 | 1 | CHMA | 3.0% | 0.10% | $10^{11}$ | 0.95 |
| Carrier 2 | 2 | 2 | CHMA | 2.5% | 0.12% | $10^{9}$ | 0.95 |
| Carrier 3 | 3 | 3 | CHMA | 3.5% | 0.08% | $10^{14}$ | 0.95 |
| Carrier 4 | 4 | 3 | CHMA | 2.8% | 0.08% | $10^{11}$ | 0.9 |

TABLE 3-continued

| | | Coating | | | | Physical properties | |
|---|---|---|---|---|---|---|---|
| | Ferrite particle | Coating dispersion | Coating resin | Coating amount | CB amount (vol) | Resistance in electric field of 19,200 V/cm (Ωcm) | Resistance ratio |
| Carrier 5 | 5 | 1 | CHMA | 3.5% | 0.10% | $10^{11}$ | 1 |
| Carrier 6 | 6 | 4 | CHMA | 2.5% | 0.00% | $10^{12}$ | 0.88 |
| Carrier 7 | 7 | 4 | CHMA | 1.8% | 0.00% | $10^{10}$ | 1.05 |

In Table 3 above, the term "resistance ratio" means $R_B/R_A$ when the resistance of the carrier in an electric field of 2,400 V/cm is expressed by $R_A$ and the resistance thereof in an electric field of 19,200 V/cm is expressed by $R_B$.

Further, the coating amount is the solid amount of the coating dispersion with respect to 100% by weight of carrier.

Preparation of Developer

Developer 1

500 g of carrier 1 and 30 g of toner 1 are put into a V blender, and mixed for 20 minutes to obtain a mixture. The obtained mixture is developer 1.

Developers 2 to 11

Developers 2 to 11 are obtained in the same manner as in the preparation of the developer 1, except that combinations of carrier and toner are changed as given in Table 4 below.

Example

Example 1

Effect Confirmation

Developer 1 is put into DCC 400 which is remodeled such that printing may be carried out at a printing speed of 120 sheets/min. Then, a cyan toner cartridge containing toner 1 is provided, and held under an environment of a temperature of 10° C. and a relative humidity (RH) of 10% for one day. Subsequently, 100,000 sheets of an A4 image, with which solid printing of 15 cm square and printing of FIG. 2 may be simultaneously performed, is printed on 100,000 sheets of paper are printed. At this time, the image unevenness and starvation (STV) of a printed matter are evaluated. Evaluation criteria are as follows.

Figure 2:
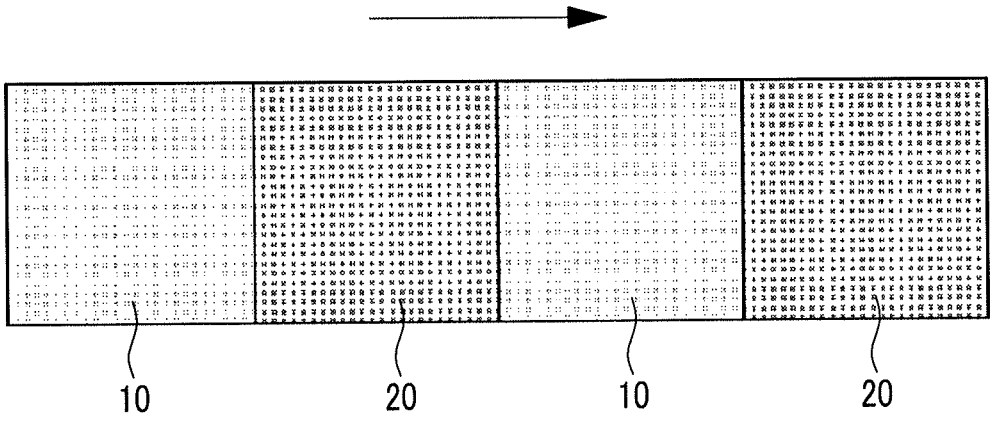
FIG. 2 is a schematic view showing an image created in Example.

Meanwhile, in FIG. 2, four 1 cm square patterns are continuously connected. Patterns having an image density of 20% (patterns indicated by reference numeral 10 in FIG. 2) and patterns having an image density of 100% (pattern indicated by reference numeral 20 in FIG. 2) are alternately and repeatedly printed. In FIG. 2, printing direction is indicated by arrow.

Image Unevenness

A: No image unevenness

B: Image unevenness is observed at 5-fold enlargement

C: Image unevenness is observed with the naked eye (range in which there is no practical problem)

D: Image unevenness is observed clearly

STV

A: No deletion between images

B: Low density portion is confirmed between the images

C: Deletion is confirmed between images (range in which there is no practical problem)

D: Deletion is clearly confirmed between images

In the image of developer 1, image unevenness is not observed, and image quality is good. Even in the image for STV, deletion is not observed, and image quality is good without fading of density.

Examples 2 to 7 and Comparative Examples 1 to 4

Examples 2 to 7 and Comparative Examples 1 to 4 are evaluated in the same manner as in Example 1, except that the developers used are changed. The results thereof are given in Table 4 below.

TABLE 4

| | | | | Evaluation | |
|---|---|---|---|---|---|
| | Developer | Carrier | Toner | Image unevenness | STV |
| Example 1 | Developer 1 | 1 | 1 | A | A |
| Example 2 | Developer 2 | 1 | 2 | B | B |
| Example 3 | Developer 3 | 1 | 3 | B | B |
| Example 4 | Developer 4 | 2 | 1 | C | B |
| Example 5 | Developer 5 | 3 | 1 | B | C |
| Example 6 | Developer 6 | 4 | 1 | C | B |
| Example 7 | Developer 7 | 5 | 1 | C | B |
| Comparative Example 1 | Developer 8 | 6 | 1 | D | D |
| Comparative Example 2 | Developer 9 | 7 | 1 | D | D |
| Comparative Example 3 | Developer 10 | 1 | 4 | D | D |
| Comparative Example 4 | Developer 11 | 1 | 5 | D | D |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developer comprising:

an electrostatic charge image developing carrier containing a ferrite particle; and an electrostatic charge image developing toner containing metallic particles whose resistance is from $10^{10}$ Ωcm to $10^{13}$ Ωcm in an electric field of 10,000 V/cm, wherein the electrostatic charge image developing carrier satisfies the following formula (1):

$$0.9 \leq R_B/R_A \leq 1.0 \quad (1)$$

wherein $R_A$ represents the resistance of the electrostatic charge image developing carrier in an electric field of 2,400 V/cm, and $R_B$ represents the resistance of the electrostatic charge image developing carrier in an electric field of 19,200 V/cm, and wherein the surface roughness Sm of the ferrite particle is from 1.0 μm to 5.0 μm, and the maximum height Ry thereof is from 0.2 μm to 0.7 μm.

2. The electrostatic charge image developer according to claim 1, wherein the resistance of the electrostatic charge image developing carrier is from $10^{10}$ Ωcm to $10^{13}$ Ωcm in an electric field of 19,200 V/cm.

3. The electrostatic charge image developer according to claim 1, wherein the electrostatic charge image developing carrier is a resin-coated carrier, and the coverage of the ferrite particles with the resin is from 85% to 99%.

4. The electrostatic charge image developer according to claim 1, wherein the metallic particle includes a metallic pigment having a first coating layer and a second coating layer, the first coating layer containing at least one metal oxide selected from the group consisting of silica, alumina and titania and the second coating layer containing a resin and covering the surface of the first coating layer.

5. The electrostatic charge image developer according to claim 1, wherein the ferrite particle is manganese ferrite.

6. The electrostatic charge image developer according to claim 1, wherein the electrostatic charge image developing carrier is a resin-coated carrier that is coated with a resin having a cycloalkyl group.

7. The electrostatic charge image developer according to claim 1, wherein the metallic particle is at least one selected from the group consisting of aluminum, brass, bronze, nickel, stainless steel, zinc, copper, silver, gold, and platinum.

8. The electrostatic charge image developer according to claim 4, wherein the second coating layer contains an acrylic resin.

9. A developer cartridge comprising a container that accommodates the electrostatic charge image developer according to claim 1.

10. A process cartridge comprising:

a developer holding member for holding and supplying the electrostatic charge image developer according to claim 1, and a container that accommodates the electrostatic charge image developer according to claim 1.

11. The electrostatic charge image developer according to claim 1, wherein the ferrite particle comprises $(MO)_X(Fe_2O_3)_Y$, wherein M represents at least one selected from the group consisting of Cu, Zn, Fe, Mg, Mn, Ca, Li, Ti, Ni, Sn, Sr, Al, Ba, Co, and Mo and each of X and Y represents a molar ratio, and X+Y=100.

* * * * *